United States Patent [19]

Risk

[11] Patent Number: 4,737,751

[45] Date of Patent: Apr. 12, 1988

[54] ROBBERY ALARM SWITCH

[76] Inventor: George Risk, 716 E. 5th St., Kimball, Nebr. 69145

[21] Appl. No.: 15,383

[22] Filed: Feb. 17, 1987

[51] Int. Cl.[4] ..... H01H 9/00

[52] U.S. Cl. ..... 335/207; 335/205; 340/574

[58] Field of Search ..... 335/205, 206, 207, 153; 340/540, 506, 507, 574

[56] References Cited

U.S. PATENT DOCUMENTS 2,010,233 8/1935 Hopkins et al. ..... 340/574

4,453,148 6/1984 Norakidze et al. ..... 335/207

*Primary Examiner*—E. A. Goldberg

*Assistant Examiner*—Lincoln Donovan

*Attorney, Agent, or Firm*—George R. Nimmer

[57] ABSTRACT

Robbery alarm switch having two independently manually engageable plungers that must be substantially simultaneously moved by a cashiering accostee to actuate a summoning alarm. The robbery alarm switch includes at least one internally housed reedswitch connected in electrically intervening relationship to the summoning alarm. The two independently manually engageable plungers are respectively provideable with an addendum source of magnetic flux (e.g. a permanent magnet) so that, when the two plungers are together independently moved teamwise from normal first-station to second-station, the two magnetic flux sources act in concert to change the distance between the reeds of every electrically intervening reedswitch and thereby actuate the summoning alarm. Included among various optional features are: a supervisorily releasable housed latch extending between the two plungers; attaching the housed reedswitch to one of the two teamwise plungers; etc.

11 Claims, 3 Drawing Sheets

ROBBERY ALARM SWITCH

BACKGROUND OF THE INVENTION

As alluded to in prior art drawing FIGS. 1A, 1B, and 1C, robbery alarm switches employable by a cashiering accostee and capable of actuating a summoning alarm oftentimes include a reedswitch internal component. In a general sense, a typical such robbery alarm switch (having a reedswitch component) is taught, intera lia, by U.S. Pat. No. 3,418,611 (Pounds—12/14/1968). A basic reedswitch (e.g. 10A) customarily comprises a pair of substantially longitudinally colinear (10) and magnetically-permeable reeds (11, 12) mounted at a finite-gap G by a surrounding magnetically-impermeable envelope (e.g. glass envelope 10E). Whenever a source of magnetic flux (e.g. permanent magnet 30A, 19) and having appropriate directional orientation of its magnetic polarities (N, S) is brought alongside the reedswitch, the reeds (11, 12) become of opposite magnetic polarities whereby the normal finite-gap (G) is extinguished. Accordingly, an external voltage potential (V) might provide an amperage flow through the reedswitch reeds (11, 12).

In prior art drawing FIGS. 1A, 1B, and 1C, "C" generally refers to an occupiable cashiering locale having a windowed (W) partition "P" intervening between a cashiering person and visitors to his/her cashiering locale. Because a would-be robber might be among such visitors, locale "C" usually has a partition attached alarm (e.g. bell "K") and electrical voltage (V), plus an intervening robbery alarm switch (SA, SB, SC) equipped with a single manual actuator (e.g. a plunger 20A). Thus, if a would-be robber accosts the cashier, he/she can depress this lone plunger (20A) to actuate alarm K for summoning police or other security personnel.

Each of the prior art robbery alarm switches (SA, SB, SC) has a rectangular housing 100 attachable to the environment (e.g. at partition "P") and including a base-panel 101 and a parallel cover-panel (herein removed for clarity). Interposed between the housing base-panel and cover-panel are: a left-panel 104, apertured right-panel 105, a bottom-panel 103, and apertured top-panel 102. Conventionally adherently or otherwise attached to base-panel 101 is a reedswitch (10A, 10B, 10C, etc.) An electrically conductive terminal (e.g. wire Y2) extends between reedswitch reed 12 (and via voltage V) and one terminus of alarm K. In the alarm switches SA and SB, another terminal (e.g. wire Y1) extends from reedswitch reed 11 toward the other terminus of alarm K. Spindle 23 of lone plunger member 20A extends through said apertured right-panel 105. Within housing 100, plunger spindle 23 carries a permanent magnet (30A) source of magnetic flux. Magnet 30A extends parallel to reedswitch axis 10 whereby its North-South (i.e. N-S) magnetic polarity is termined as "relatively longitudinal". Externally of of housing 100, plunger spindle 23 carries a manually engageable pushbutton 21. For this lone or "alpha" plunger member 20A, a helical spring 24 surrounds spindle 23 between right-panel 105 and pushbutton 21. Thus, alpha-plunger 20A has a normal first-station wherein the non-housed pushbutton part (21) is located relatively remote from the housing and wherein its housed magnet addendum (30A) is located sufficiently remote from the reedswitch so as to not influence the distance between the reedswitch reeds 11 and 12. However, and as aptly indicated in the phantom lines, when pushbutton part 21 is manually depressed toward housing panel 105, plunger 20A assumes a second-station wherein its housed magnet addendum (30A) is located relatively nearer to the reedswitch and effects a change in the distance between the reed-switch reeds (11, 12).

For robbery alarm switch SA of FIG. 1A, the housed reed-switch is elementary and non-supplemented by a co-stationed biasing-magnet (e.g. 19); hence, it is termed a "normally-open" reedswitch 10A i.e. having gap "G" between reeds 11 and 12 when plunger 20A is at normal first-station. However, when plunger 20A is manually depressed to its second-station, magnet addendum 30A there sufficiently magnetically attracts reeds 11 and 12 whereby gap "G" is extinguished and electrical current might flow between the reeds to actuate alarm K.

On the other hand, robbery alarm switch SB of FIG. 1B uses an elementary reedswitch co-supplemented by a biasing-magnet (e.g. 19), and hence, is termed a "normally-closed" reedswitch 10B. Appropriate in this regard, a conventional relay "R" (and typically comprising coil and resiliently pivoted contacts) is interposed between voltage "V" and wire Y1. Accordingly, when plunger 20A is manually depressed to its second-station, addendum magnet 30A, which has a polarity orientation opposite to that for biasing-magnet 19, magnetically neutralizes biasing-magnet 19 whereby gap "G" is re-established and electrical current might flow between the reeds to actuate alarm K.

FIG. 1C illustrates another "normally-closed" switch SC that utilizes a single-pole double-throw type reedswitch 10C. Such prior art reedswitch 10C differes primarily from elementary reedswitches 10A and 10B in that envelope 10E tends to ensure that a third and magnetically-impermeable reed 13 normally touches reed 12 but is spatially offset from reed 11. Accordingly, when plunger 20A is manually depressed to its second-station, magnet addendum 30A sufficiently attracts magnetically-permeable reeds 11 and 12 whereby gap "G" is extinguished and electrical current flows therebetween to actuate alarm K.

Admittedly, the prior art robbery alarm switches alluded to in the aforedescribed drawing FIGS. 1A, 1B, and 1C, will reliably actuate a summoning alarm (K) whenever a cashiering person causes depressible movement of the plunger activator (20A). Unfortunately, there is the likely possibility that a busy cashiering person might inadvertently bump into such sole activator (e.g. 20A) and accidentially actuate the summoning alarm to a "false alarm" status. Such inadvertent "false alarm" is not only embarrassing to the cashier, but also represents a costly waste of the needlessly responding police or other summoned security personnel.

OBJECT OF THE INVENTION

In view of the immediately foregoing, it is the general objective of the present invention to provide a robbery alarm switch based upon the intervening reedswitch concept and which is activatable by the single hand of an accosted cashier, but which is vastly improved in being resistant to inadvertent accidental activation by a cashier during routine non-emergency situations. It is an ancillary general objective to provide, for such improved robbery alarm switch concept, the attendant capability of enabling a cashiering superintendant to identify with subordinate cashiering person had been responsible for actuating the summoning alarm from his own assigned robbery alarm switch

GENERAL STATEMENT OF THE INVENTION

With the above general objectives in view, and together with other ancillary and specific objectives which will become more apparent as this description proceeds, the improved robbery alarm switch concept of the present invention generally comprises: a housed reedswitch means wherein the respective reedswitches are in electrically intervening relationship to the environmental summoning alarm, whereby it is necessary to change the distance between the two magnetically-permeable reeds of said at least one reedswitch with a movable source of magnetic flux (e.g. a permanent magnet) to actuate the summoning alarm; perhaps a pair of magnetic flux sources required to be substantially simultaneously moved to actuate said alarm; a pair of manually engageable plungers independently movably associated with disparate portions of the robbery alarm switch housing, the respective plungers (internally of said housing) adapted to carry a magnetic flux addendum whereby, and only when, when the two plungers are substantially simultaneously moved teamwise from a normal first-station to a second-station, such magnetic flux addenda can act in concert to change the distance between critically intervening reeds and thus actuate the alarm; and together with other desirable novel optional features including, inter alia, supervisorily releasable latching means extending between the two second-station positions of the teamed plungers, attaching the housed reedswitch means to one of the two teamed plungers, etc.

BRIEF DESCRIPTION OF THE DRAWING

In the drawing, wherein like characters refer to like parts in the several views, and in which.

DETAILED DESCRIPTION OF THE DRAWING

Figure 1A:
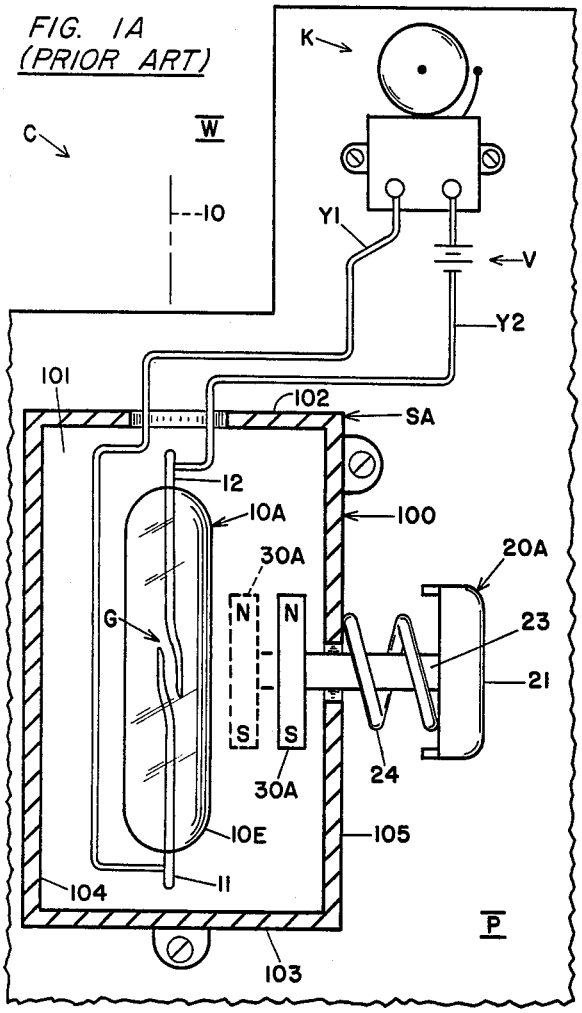
FIG. 1A (PRIOR ART)
FIGS. 1A, 1B, and 1C (aforedescribed) are elevational views as seen by a cashiering person at three related prior art robbery alarm switches SA, SB, and SC. Cover-plates for the alarm switch housing (100) are removed for purposes of clarity.
Figure 2:
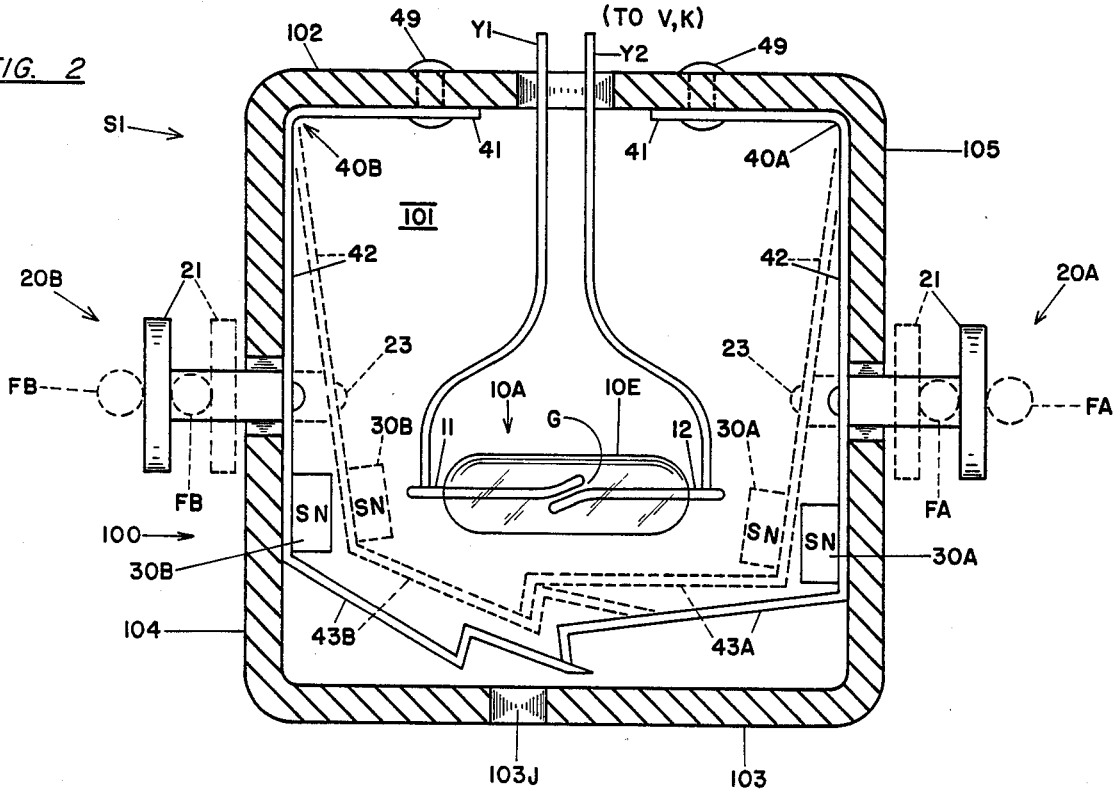
FIG. 2 is an elevational view (similar to FIGS. 1A, 1B, and 1C) of a first representative embodiment S1 of the improved robbery alarm switch concept of the present invention.

A comparison of drawing FIGS. 1A and 2 reveals that first representative embodiment S1 includes the following components from prior art switch embodiment SA:

(a) a housing 100 attachable to a cashiering environment (e.g. to partitioning "P");

(b) a single normally-open reedswitch (10A) stationarily attached to housing base-panel 101. Electrically conductive wire Y1 extends from reed 11 (and via apertured top-panel 102) to alarm K, and similar wire Y2 extends from reed 12 to alarm voltage V;

(c) spindle 23 of alpha-plunger 20A reciprocatably extends through apertured right-panel 105; and (d) a permanent bar magnet 30A that is co-reciprocatable with alpha-plunger 20A.

Departing from embodiment SA, representative novel embodiment S1 employs reedswitch 10A extending longitudinally (10) in a perpendicular relationship to housing panels 104 and 105. Replacing helical spring 24 of embodiment SA is a pair of internally housed leaf-springs 40A and 40B flanking reedswitch 10A and for resiliently urging plungers 20A and 20B away from reedswitch 10A. These leaf-springs 40 have:

(i) identical horizontal first-legs 41 attached to housing top-panel 102 with fasteners 49;

(ii) identical and preponderant vertical second-legs 42 extending immediately alongside left-panel 104 and right-panel 105, respectively; and (iii) mateably latchable third-leg terminal lengths 43A and 43B, respectively. Nearer to first-leg 41 than to third-leg 43A, the housed portion for spindle 23 of alpha-plunger 20A is attached to second-leg 42 of leaf-spring 40A. Nearer to third-leg 43A than to first-leg 41, the second-leg of leaf-spring 40A carries said bar magnet 30A and in a condition wherein the N-S magnetic orientation is directionally similar to that (10) of reedswitch 10A. At both the normal first-station and the second-station for alpha-plunger 20A, magnet addendum 30A is located so remote from reedswitch reeds 11 and 12 as to be incapable by itself of extinguishing the inter-reeds gap "G" of reedswitch 10A.

Also departing from prior art embodiment SA, novel embodiment S1 employs a twin (20B) of alpha-plunger 20A and a co-reciprocatable magnet 30B. Spindle 23 of this twin or "beta" plunger 20B recriprocatably extends through housing apertured left-panel 104. Nearer to first-leg 41 than to third-leg 43B, the beta-plunger (20B) spindle 23 is attached to second-leg 42 of leaf-spring 40B. Nearer to third-leg 43B than to first-leg 41, second-leg 42 of leaf-spring 40B carries said bar magnet 30B and in a condition wherein the N-S magnetic orientation is directionally similar to that (10) of reedswitch 10A. Moreover, the magnetic orientation of co-elevational magnets 30A and 30B is of opposite polarity. At both the normal first-station and the second-station for beta-plunger 20B, magnet addendum 30B is incapable by itself of extinguishing the inter-reeds gap "G" of reedswitch 10A. It is only when both plungers 20A and 20B are substantially simultaneously depressed from first-stations (solid lines) to second-stations (phantom lines) will their co-movable magnetic flux addenda (30A, 30B) be capable of extinguishing the inter-reeds gap "G" of reedswitch 10A and thereby actuate the summoning alarm (e.g. K). In the latter regard, at second-stations, the aggregate of the alpha Gauss-value for magnet 30A and the beta Gauss-value for magnet 30B is just adequate to extinguish gap "G" between reedswitch reeds 11 and 12.

"FA" and "FB" indicate that the thumb and the index finger of an accostee's single hand might be utilized for substantially simultaneously depressing teamed plungers 20A and 20B.

As also seen in the FIG. 2 phantom line condition, at second-stations for simultaneously activated plungers 20A and 20B, their co-movable leaf-springs 40 become releasably mateably engaged at appropriately contoured third-legs 43A and 43B. Release of the mateably latched third-legs might be accomplished by inserting a probling stylus through bottom-panel aperture 103J and upwardly against the mated (but upwardly deflectably releasable) third-legs. Upon such release, the plungers 20A and 20B automatically return to their normal first-stations. The probing stylus might be in the possession of a cashiering supervisor who has the responsibility of following-up upon every instance of alarm actuation through a subordinate's activation of his/her assigned robbery alarm switch S1, etc.

Figure 1B:
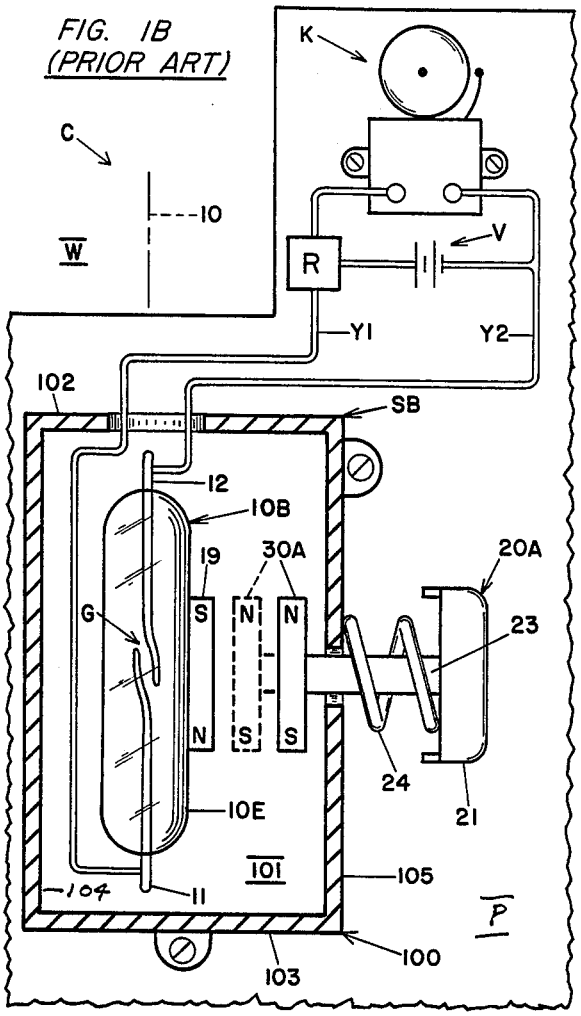
FIG. 1B (PRIOR ART)
Figure 3:
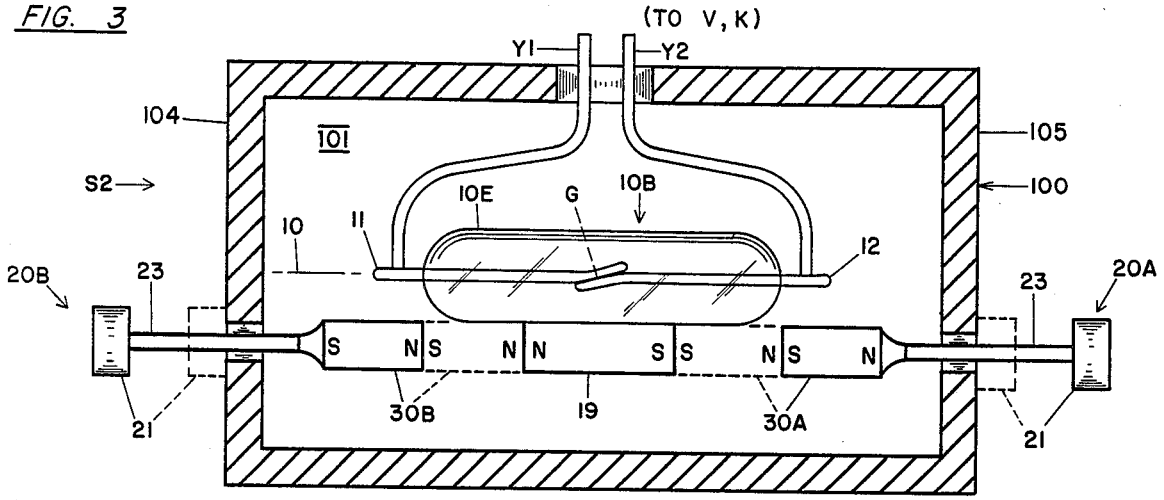
FIG. 3 is an elevational view of a second embodiment S2 of the robbery alarm switch concept of the present invention.

Next, a comparison of drawing FIGS. 1B and 3 reveals that second switch embodiment S2 includes the following components from prior art switch embodiment SB;

(a) housing 100 attachable to a cashiering environment (e.g. to partitioning "P"), (b) a single normally-closed reedswitch (10B), including its biasing-magnet 19, being attached to housing base-panel 101;

(c) spindle 23 of alpha-plunger 20A reciprocatably extends through apertured right-panel 105; and (d) a permanent bar magnet 30A that is co-reciprocatable with alpha-plunger 20A.

Departing from embodiment SB, novel embodiment S2 employs arrayed biasing-magnet 19 and reedswitch 10B extending longitudinally in perpendicular relationship to housing panels 104 and 105. Moreover, a twin (20B) of alpha-plunger 20A reciprocatably extends through housing apertured left-panel 104. Also departing from embodiment SB, magnetic addenda 30A and 30B have colineal N-S polarities with respect to that for biasing-magnet 19. The aggregate of the alpha Gauss-value for magnet 30A and the beta Gauss-value for magnet 30B just exceeds the bias Gauss-value for biasing-magnet 19. Thus, it is only when both plungers 20A and 20B are substantially simultaneously depressed from first-stations (solid lines) to second-stations (phantom lines) will their co-movable magnetic flux addenda (30A, 30B) be capable of establishing an inter-reeds gap "G" of reedswitch 10B and thereby actuate the summoning alarm (e.g.K).

Figure 4:
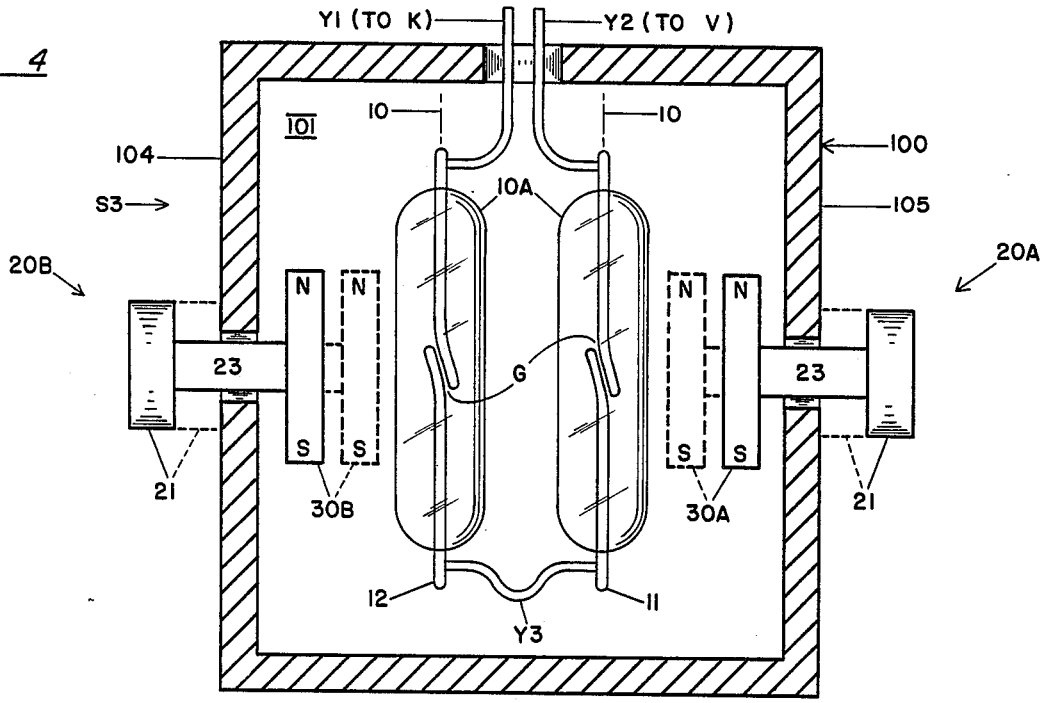
FIG. 4 is an elevational view of a third embodiment S3.

Next, a comparison of drawing FIGS. 1A and 4 reveals that novel switch embodiment S3 represents a substantially replication of the essential components of FIG. 1A plus a short wire (Y3) connecting two normally-open reedswitches 10A. Accordingly, the reedswitch means consists of two normally-open reedswitches 10A denominated as alpha-reedswitch and as beta-reedswitch. However, by virtue of introduced beta-plunger 20A and beta-magnet 30B, it is only when both plungers 20A and 20B are substantially simultaneously depressed from first-stations (solid lines) to second-stations (phantom lines) will their co-movable magnetic flux addenda (30A, 30B) be capable of extinguishing the two serially arranged inter-reeds gaps "G" and thereby actuate the summoning alarm (e.g. K).

Figure 5:
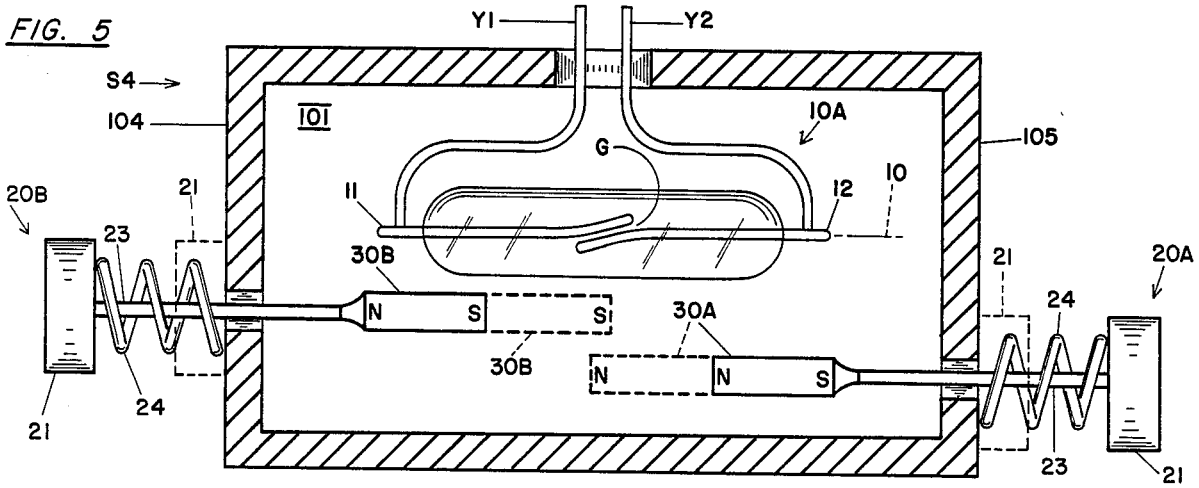
FIG. 5 is an elevational view of a fourth embodiment S4.

Switch embodiment S4 of drawing FIG. 5 is structurally related to embodiment S2 of FIG. 3. However, since embodiment S4 utilizes a normally-open reedswitch 10A (the FIG. 3 biasing-magnet 19 being unnecessary) the longitudinal travel for plunger spindles 23 is appropriately relatively lengthier. Thus, at plungers' second-stations (phantom lines), non-coelevational magnetic addenda 30A and 30B have their polarities positioned to extinguish gap "G" of reedswitch 10A.

Figure 6:
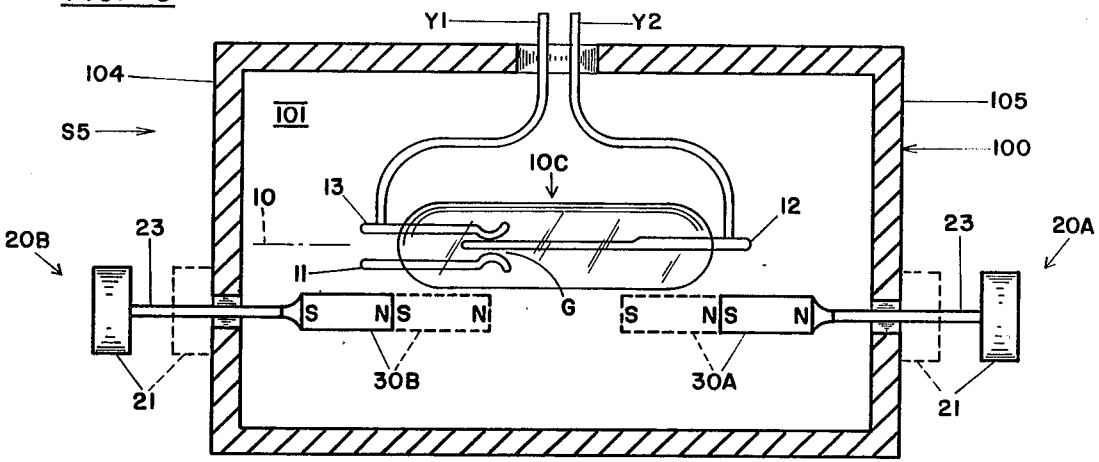
FIG. 6 is an elevational view of a fifth embodiment S5.
Figure 1C:
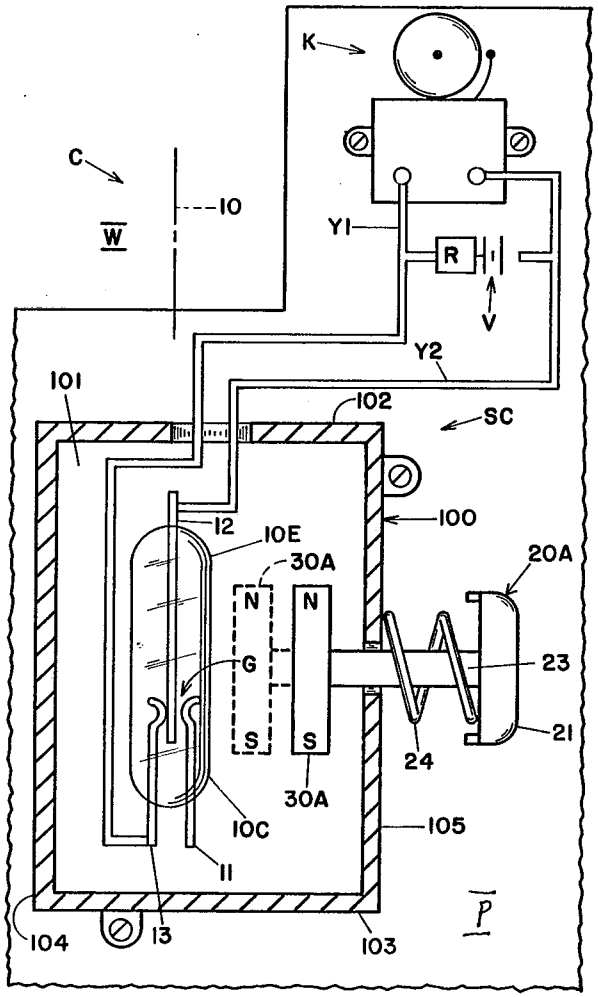
FIG. 1C (PRIOR ART)

Next, a comparison of drawing FIGS. 1C and 6 reveals that novel switch embodiment S5 includes the following components of prior art switch embodiment SC:

(a) a housing 100 attachable to a cashiering environment (e.g. to partitioning "P");

(b) a single reedswitch 10C of the single-pole double-throw type and being attached to housing base-panel 101;

(c) spindle 23 of alpha-plunger 20A reciprocatably extends through apertured right-panel 105; and (d) a permanent bar magnet 30A that is co-reciprocatable with alpha-plunger 20A.

Departing from switch embodiment SC, novel embodiment S5 employs reedswitch 10C extending longitudinally (10) in a perpendicular relationship to housing panels 104 and 105. Moreover, a twin (20B) of alpha-plunger 20A (e.g. beta-plunger 20B having magnet 30B) extends through apertured left-panel 104. Also departing from embodiment SC, the aggregate Gauss-values for magnets 30A and 30B at plungers second-stations is just sufficient to extinguish gap "G" between reedswitch reeds 11 and 12. Thus, it is only when both plungers 20A and 20B are substantially simultaneously depressed from first-stations (solid lines) to second-stations (phantom lines) will their co-movable magnetic flux addenda (30A, 30B) be capable of extinguishing the interreeds gap "G" of reedswitch 10C and thereby actuate the summoning alarm (e.g. K).

Figure 7:
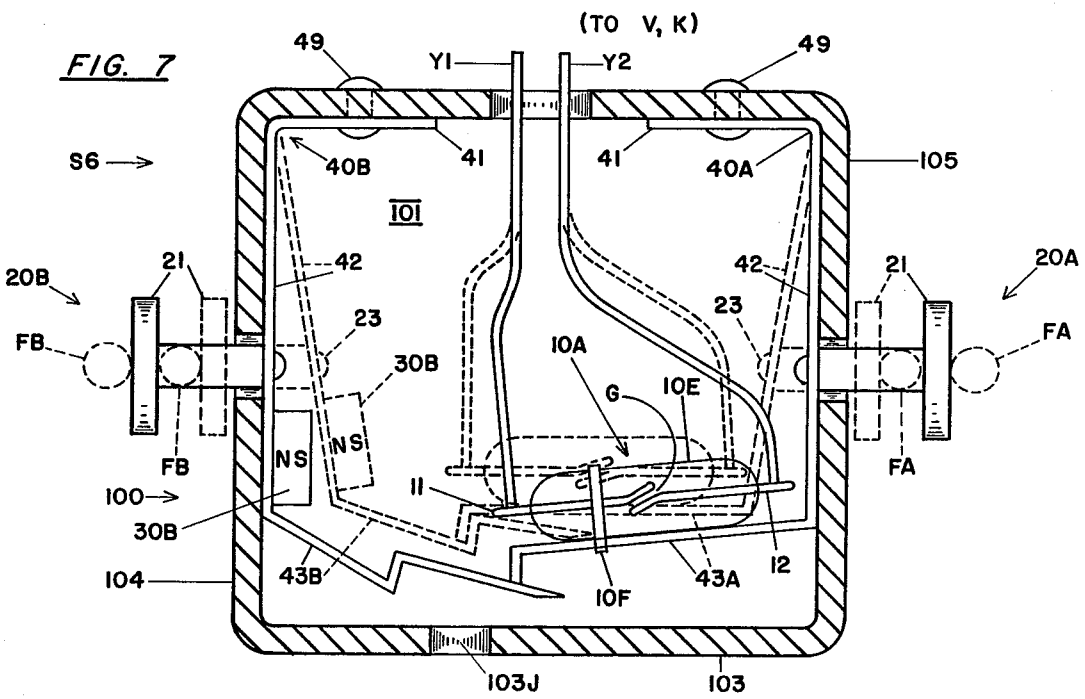
FIG. 7 is an elevational view of a sixth embodiment S6.

Finally, turning to FIG. 7 which depicts a sixth representative embodiment S6 of the robbery alarm switch of the present invention. A comparison of drawing FIGS. 2 and 7 reveals that embodiemnt S6 is very closely structurally related to embodiment S1, except as follows:

(a) embodiment S6 does not employ the alpha-magnet 30A of embodiment S1. In a related vein, the beta Gauss-value for the sole magnet (30B) used in embodiment S6 is about double the Gauss-value of the embodiment S1 magnet 30B; and (b) departing from the embodiment S1 situation (i.e. wherein the normally-open reedswitch 10A is stationarily mounted to housing base-panel 101), in embodiment S6 the normally-open reedswitch 10A is co-directional with and is attached to (e.g. by plastic band 10F) the terminal length 43A of leaf-spring 40A. Thus, analagously for embodiment S6, it is only when both plungers 20A and 20B are substantially simultaneously depressed from first-stations (solid lines) to second-stations (phantom lines) will the co-movable magnetic flux (e.g. magnet 30B) be capable of extinguishing the inter-reeds gap "G" of reedswitch 10A and thereby actuate the summoning alarm (e.g. K).

From the foregoing, the construction and operation of the robbery alarm switch concept of the present invention will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. Robbery alarm switch comprising:

(A) a hollow housing provided with electrically conductive terminals for connection to respective reeds of a reedswitch means;

(B) said reedswitch means being stationarily mounted within said hollow housing and consisting of a normally-open reed-switch having longitudinally extending reeds that are transversely spaced at a finite gap opening; and (C) a pair of directionally longitudinally extending plungers longitudinally slidably engaged with said housing on opposite sides of said normally-open reedswitch whereby each plunger has a first-station located relatively remote from the reedswitch means and also has a second-station located relatively nearer to said reed-switch means, one of said plungers being an alpha-plunger carrying a permanently housed permanent magnet that has an alpha Gauss-value insufficient to extinguish the gap opening between the reedswitch reeds, the second of said plungers being a beta-plunger carrying a permanently housed permanent magnet that has a beta Gauss-value insufficient to extinguish the gap opening between the reedswitch reeds, and the aggregate of said alpha and beta Gauss-values being sufficient to extinguish a gap opening between the reedswitch reeds whenever both plungers are at second-station.

2. The robbery alarm switch of claim 1 wherein said normally-open reedswitch is of the single-pole double-throw type.

3. The robbery alarm switch of claim 1 wherein both said plungers are respectively resiliently urged longitudinally away from the reedswitch means and toward their first-stations with longitudinally separated leaf-springs.

4. The robbery alarm switch of claim 2 wherein the longitudinally separated leaf-springs are capable of being removably latched together whenever both plungers are substantially simultaneously moved from first-station to second-station.

5. The robbery alarm switch of claim 4 wherein the housing is apertured in alignment with a latched condition of the leaf-springs whereby a cashiering supervisor might insert a probing tool through said housing aperture to release the removably latched leaf-springs and permit them to resiliently return to plungers first-stations.

6. Robbery alarm switch comprising:

(A) a hollow housing provided with electrically conductive terminals for connection to the respective reeds of a reed-switch means;

(B) said reedswitch means being stationarily mounted within said hollow housing and consisting of a reedswitch having longitudinally extending reeds and said reeds being effected into a normally-closed condition with a stationarily housed biasing-magnet having a bias Gauss-value; and (C) a pair of directionally longitudinally extending plungers longitudinally slidably engaged with said housing on opposite sides of said normally-closed reedswitch whereby each plunger has a first-station located relatively remote from the reedswitch means and also has a second-station located relatively nearer to said reed-switch means, one of said plungers being an alpha-plunger carrying a permanently housed permanent magnet that has a alpha Gauss-value less than said bias Gauss-value, the second of said plungers being a beta-plunger carrying a permanently housed permanent magnet that has a beta Gauss-value less than said bias Gauss-value, and the aggregate of said alpha and beta Gauss-value exceeding said bias Gauss-value whenever both plungers are at second-station.

7. The robbery alarm switch of claim 6 wherein both said plungers are respectively resiliently urged away from the reedswitch means and toward their first-stations with leaf-springs.

8. The robbery alarm switch of claim 7 wherein the leaf-springs are capable of being removably latched together whenever both plungers are moved teamwise from first-station to second-station.

9. Robbery alarm switch comprising:

(A) a hollow housing provided with electrically conductive terminals for connection to respective reeds of a reedswitch means;

(B) said reedswitch means being stationarily mounted within said hollow housing and consisting of a pair of substantially parallel, normally-open reedswitches including an alpha-reedswitch and a beta-reedswitch, each of said reedswitches having directionally longitudinally extending reeds that are transversely spaced at a finite gap opening; and (C) a pair of directionally transversely extending plungers slidably engaged with said housing on opposite sides of said paired reedswitches including an alpha-plunger adjacent the alpha-reedswitch and a beta-plunger adjacent the beta-reedswitch, each plunger having a first-station located relatively remote from the paired reedswitches and also having a second-station located relatively nearer to said paired reedswitches, said alpha-plunger carrying a permanently housed permanent magnet that has an alpha Gauss-value which is sufficient at alpha-plunger second-station to extinguish the gap opening between the alpha-reed-switch reeds, and said beta-plunger carrying a permanently housed permanent magnet that has a beta Gauss-value which is sufficient at beta-plunger second-station to extinguish the gap opening between the beta-reedswitch reeds.

10. Robbery alarm switch comprising:

(A) a hollow and substantially rectangular housing having a top-panel overlying a bottom-panel and a left-panel directionally longitudinally spaced from a right-panel, said hollow housing being provided with electrically conductive terminals for connection to the respective reeds of a normally-open reedswitch;

(B) a pair of leaf-springs located within said housing and including a leftward leaf-spring attached to said housing and extending alongside the left-panel and also including a rightward leaf-spring attached to said housing and extending alongside the right-panel, and at least one of said leaf-springs being provided with a terminal length overlying and extending alongside said housing bottom-panel;

(C) an alpha-plunger extending through the housing left-panel and contacting said leftward leaf-spring whereby said leftward leaf-spring normally urges the alpha-plunger away from said rightward leaf-spring and a beta-plunger therefor;

(D) a beta-plunger extending through the housing right-panel and contacting said rightward leaf-spring whereby said rightward leaf-spring normally urges the beta-plunger away from said leftward leaf-spring and alpha-plunger therefor; and (E) one of said leaf-springs along said terminal length carrying said normally-open reedswitch, and the other of said leaf-springs carrying a permanent magnet having a Gauss-value sufficient for extinguishing the gap between the reedswitch reeds whenever both plungers are manually actuated teamside toward each other.

11. The robbery alarm switch of claim 10 wherein both said leaf-springs are provided with a longitudinally extending terminal length, said two terminal lengths being contoured for removably latching together whenever both plungers are substantially simultaneously moved from first-station to second-station.

* * * * *